United States Patent [19]

Griffis

[11] 4,239,939

[45] Dec. 16, 1980

[54] STEREOPHONIC SOUND SYNTHESIZER

[75] Inventor: Patrick D. Griffis, Indianapolis, Ind.

[73] Assignee: RCA Corporation, New York, N.Y.

[21] Appl. No.: 18,905

[22] Filed: Mar. 9, 1979

[51] Int. Cl.[3] ..... H04S 5/00

[52] U.S. Cl. ..... 179/1 GP; 358/198

[58] Field of Search ..... 179/1 GP, 1 D, 1 GQ, 179/1 G, 100.4 ST; 358/198

[56] References Cited

U.S. PATENT DOCUMENTS

| | | | |
|---|---|---|---|
| 2,616,970 | 11/1952 | Broos | 179/1 GP |
| 3,056,854 | 10/1962 | Katzenstein | 179/1 GP |
| 3,676,106 | 6/1972 | Orban | 179/1 GP |
| 4,137,510 | 1/1979 | Iwahara | 179/1 D |

OTHER PUBLICATIONS

"Constant-Voltage Crossover Network Design", by Small in *Proceedings I.R.E.E. Australia,* vol. 31, No. 3, Mar. 1970, pp. 66–73.

"An Artificial Stereophonic Effect Obtained From a Single Audio Signal", by Schroeder in *Journal of the Audio Engineering Society,* Apr. 1958, vol. 6, No. 2, pp. 74–79.

"A Rational Technique for Synthesizing Pseudo-Stereo From Monophonic Sources", by Orban in *Journal of the Audio Engineering Society, Apr. 1970, vol. 18, No. 2, pp. 157–164.*

*Primary Examiner*—Douglas W. Olms

*Attorney, Agent, or Firm*—Eugene M. Whitacre; William H. Meagher; W. Brinton Yorks, Jr.

[57] ABSTRACT

A system is provided which synthesizes stereophonic sound by developing two separate sound channels from a single monophonic sound source. A synthetic stereophonic sound system constructed in accordance with the principles of this invention may be advantageously utilized in combination with a visual display such as a television receiver. A monaural signal is applied as the input signal for a transfer function circuit of the form H(s), which modulates the intensity of the monaural signal as a function of frequency. The intensity modulated H(s) signal is coupled to a reproducing loudspeaker, and comprises one channel of the synthetic stero system. The H(s) signal is also coupled to one input of a differential amplifier. The monaural signal is coupled to the other input of the differential amplifier to produce a difference signal which is the complement of the H(s) signal. The difference signal is coupled to a second reproducing loudspeaker, which comprises the second channel of the synthetic stereo system. In accordance with a preferred embodiment of the present invention, a stereo synthesizer is utilized as the sound reproducing system of a television receiver, with the reproducing loudspeakers located on either side of the kinescope. The amplitude -vs- frequency response curves of the two output channels have crossover points at which the amplitudes of the two response curves are equal, which effectively centers sounds at these frequencies between the loudspeakers. Two crossover frequencies are chosen to occur at approximately the frequency of peak intensity of the human voice, and at the center frequency of the second (articulation) formant frequencies of the human voice so as to effectively center voices on the kinescope while preserving the ambience effect of other, more randomly distributed sound signals. Centering the second formant frequencies also provides increased quality in the reproduction of speech sounds.

24 Claims, 7 Drawing Figures

MONO IN
10
A.
M
f
20
H(s)
40
B.
C.
H(s)
M-H(s)

MONO IN
100
102
820 Ω
20
H(s)
200
150 Hz NOTCH
.22 μF
202
2.4 k
204
206
208
4.7 k
210
212
4.7 k
.47 μF
220
4600 Hz NOTCH
1000 pF
222
18 k
224
226
228
33 k
230
232
33 k
2200 pF

150 Ω
104
500 Ω
106
1 μF
108
11 k
110
.01 μF
112
1000 pF
114
40
42
330 k
124
9.1 k
122
1 μF
120
H(s)
100 μF
130
27 Ω
126
1 μF
128
150
152
154
156
170
H(s)-M
100 μF
140
27 Ω
134
1 μF
136
330 k
132
158
160
162
172

170
172
180
182

STEREOPHONIC SOUND SYNTHESIZER

This invention relates to a system which synthesizes stereophonic sound by developing two separate sound channels from a single monophonic sound source in general and, in particular, to the employment of such a synthetic stereophonic sound system in combination with a visual display such as a television receiver.

When a sound source such as an orchestra is recorded and reproduced monophonically, much of the color and depth of the recording is lost in the reproduction. For example, when the orchestra is recorded on a single sound channel by a single microphone, then reproduced through two spatially separated loudspeakers, the orchestral sounds will appear to emanate from a point intermediate the loudspeakers to a centrally located listener. The monophonic reproduction will give the listener a "hole-in-the-wall" sound sensation. This is because the direct sounds produced by the orchestra will all converge simultaneously at the microphone, be recorded, and reproduced the same way; sounds, such as those produced by reflections due to the acoustic characteristics of the recording room, will be overpowered, or masked, by the direct sounds and will be lost.

But when the orchestra is recorded on two different sound channels by two separate (and separated) microphones, the indirect sounds due to the recording room acoustics are not lost. This is because the two microphones are each recording direct sounds which arrive by different sound paths. Thus, the direct sounds of one microphone will have their reflected or indirect sounds recorded by the other microphone. Since the direct sounds at the latter microphone differ from those of the former, only minimal masking will occur. Upon reproduction, the orchestra does not appear to emanate from a "hole-in-the-wall", but instead appears to be distributed throughout and behind the plane of the two loudspeakers. The two-channel recording results in the reproduction of a sound field which enables a listener to both locate individual instruments and to sense the acoustical character of the recording room or concert hall.

Beginning with the work of H. Lauridsen in 1956, various efforts have been directed toward creating the sensation of two-channel stereo synthetically. Such a synthetic or quasi-stereophonic system attempts to create an illusion of spatially distributed sound waves from a single monophonic signal. Lauridsen obtained this effect by delaying a monophonic signal A by 50–150 milliseconds to develop a signal B. A listener using separate earphones received an A+B signal in one earphone and A–B signal in the other. The listener received a fairly definite spatial impression of the sound field.

The synthetic stereophonic effect arises due to an intensity -vs- frequency as well as an intensity -vs- time difference in the indirect signal pattern set up at the two ears. This gives the impression that different frequency components arrive from different directions due to room reflection echoes, giving the reproduced sound a more natural, diffused quality.

True stereophony is characterized by two distinct qualities which distinguish it from single-channel reproduction. The first of these is directional separation of sound sources and the second is the sensation of "depth" and "presence" that it creates. The sensation of separation has been described as that which gives the listener the ability to judge the selective location of various sound sources, such as the position of the instruments in an orchestra. The sensation of presence, on the other hand, is the feeling that the sounds seem to emerge, not from the reproducing loudspeakers themselves, but from positions in between and usually somewhat behind the loudspeakers. The latter sensation gives the listener an impression of the size, acoustical character, the depth of the recording location. In order to distinguish between presence and directional separation, which contributes to presence, the term "ambience" has been used to describe presence when directional separation is excluded. Experiments by Lochner and Keet have led to the conclusion that the sensation of ambience contributes far more to the stereophonic effect than separation.

Two-channel stereophonic sound reproduction preserves both qualities of directional separation and ambience. Synthesized stereophonic sound reproduction, however, does not attempt to recreate stereo directionality, but only the sensation of depth and presence that is a characteristic of true two-channel stereophony. However, some directionality is necessarily introduced, since sounds of certain frequencies will be reproduced fully in one channel and sharply attenuated in the other as a result of either phase or amplitude modulation of the signals of the two channels.

When a two-channel stereophonic sound reproduction system is utilized in combination with a visual medium, such as television or motion pictures, the two qualities of directional separation and ambience create an impression in the mind of the viewer listener that he is a part of the scene. The sensation of ambience will recreate the acoustical properties of the recording studio or location, and the directional sensation will make various sounds appear to emanate from their respective locations in the visual image. In addition, since the presence sensation produces the feeling that sounds are coming from positions behind the plane of the loudspeakers, a certain three-dimensional effect is also produced.

The use of a synthesized stereophonic sound reproduction system in combination with a visual medium will produce a somewhat similar effect to that which is realized with two-channel stereo. By controlling the relative amplitudes and/or phases of the sound signals which are coupled to the reproducing loudspeakers as a function of frequency, a sensation of ambience will be created in the mind of the viewer. In one respect, the ambience sensation produced by synthesized stereo is better suited to the visual medium than that produced by two-channel stereo. This is because, as Lochner and Keet discovered, the apparent width of the sound field created by two-channel stereo is generally greater than that created by synthesized stereo. The two-channel stereo sound field can in fact appear to be wider than the visual image being viewed, with certain sounds coming from beyond the limits of the image. Tests involving television viewers have demonstrated that these apparent "off-stage" sounds can be disturbing to the viewer, as the sounds heard do not seem to be correlated with the scene being viewed, resulting in viewer confusion. This viewer disorientation is less likely to occur with synthesized stereo, since its recreated sound field is generally narrower than that of a two-channel stereo system.

It is also possible for the synthesized stereo system to create a disturbing separation sensation in the mind of the viewer if the frequency spectrum is improperly divided by the two loudspeakers. As explained above, the synthesized stereo system achieves its intended effect by controlling the relative amplitudes and/or phases of the sound signals as a function of the audible frequency spectrum at the reproducing loudspeakers. Suppose that a television viewer is watching and listening to a scene including a speaker with a bass voice on the left side of the viewing area, and a speaker with a soprano voice on the right side. Two reproducing loudspeakers are located to the left and right of the image, evenly spaced from the center of the image. Most of the sound power of the bass voice will be concentrated below 350 Hz, and most of the sound power of the soprano speaker will appear above this frequency. If the frequency spectrum is divided such that frequencies below 350 Hz are emphasized by the right loudspeaker and attenuated in the left loudspeaker, and frequencies above 350 Hz are emphasized by the left loudspeaker and attenuated in the right loudspeaker, the bass voice will emanate from the right side of the scene, and the soprano voice will emanate from the left side of the scene, which is the reverse of the speakers' images. This confusing effect will be very annoying to the viewer/-listener.

In accordance with the principles of the present invention, a stereophonic sound synthesizer is provided which develops two complementary spectral intensity modulated signals from a single monaural signal. The monaural signal is applied as the input signal for a transfer function circuit of the form H(s), which modulates the intensity of the monaural signal as a function of frequency. The intensity modulated H(s) signal is coupled to a reproducing loudspeaker, and comprises one channel of the synthetic stereo system. The H(s) signal is also coupled to one input of a differential amplifier. The monaural signal is coupled to the other input of the differential amplifier to produce a difference signal which is the complement of the H(s) signal. The difference signal is coupled to a second reproducing loudspeaker, which comprises the second channel of the synthetic stereo system.

In accordance with a preferred embodiment of the present invention, a stereo synthesizer is utilized as the sound reproducing system of a television receiver, with the reproducing loudspeakers located on either side of the kinescope. The H(s) transfer function circuit is comprised of two twin-tee notch filters, which produce notches of reduced signal level at 150 Hz and 4600 Hz. The output signal produced by the differential amplifier has signal level peaks at these notch frequencies, and a complementary notch at the H(s) signal peak at 700 Hz. Between the notch frequencies, the H(s) channel signal and the difference channel signal are in a substantially constant 90 degree phase relationship, which provides a sound field which is distributed between, but does not appear to be distributed beyond, the space between the two loudspeakers. The amplitude -vs- frequency response curves of the two output channels have crossover points at which the amplitudes of the two response curves are equal, which effectively centers sounds at these frequencies between the loudspeakers. The notch frequencies are chosen such that two of these crossover points occur at approximately the frequency of peak intensity of the human voice, and at the center frequency of the second (articulation) formant frequencies of the human voice, respectively, so as to effectively center voices on the kinescope while preserving the ambience effect of other, more randomly distributed sound signals. Centering the second formant frequencies also provides increased quality in the reproduction of speech sounds.

Figures 1, 2, 3:
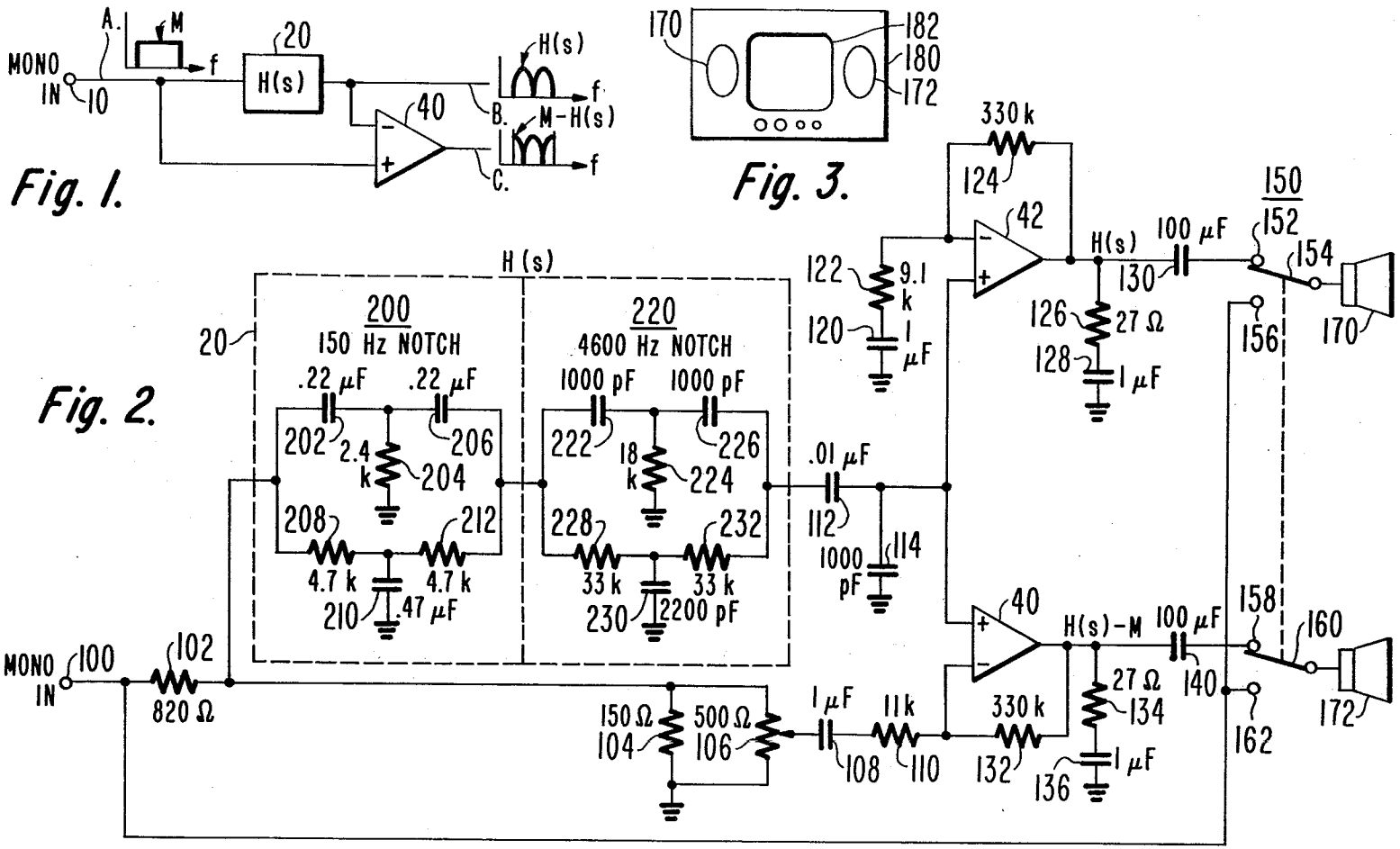
FIG. 1 illustrates in block diagram form a stereo synthesizer constructed in accordance with the principles of the present invention.
FIG. 2 illustrates in schematic detail a stereo synthesizer constructed in accordance with the principles of the present invention.
FIG. 3 illustrates a frontal view of a television receiver which employs the stereo synthesizer of FIG. 2.

Referring to FIG. 1, a stereo synthesizer constructed in accordance with the principles of the present invention is illustrated in block diagram form. A monaural sound signal M originating from a source having a typical response curve shown at A of the figure is coupled from an input terminal 10 to a transfer function circuit 20 and to the positive input of a differential amplifier 40. The transfer function is expressed as H(s), where (s) represents a complex variable in Laplace transform notation. The output of the transfer function circuit 20 is coupled to the negative input of the differential amplifier 40.

The transfer function H(s) has a characteristic amplitude response which varies with frequency. This results in modulation of the intensity of the M signal over its frequency spectrum. The frequency response of the transfer function circuit 20 is sharply attenuated at certain frequencies, and relatively unattenuated (or amplified) at other frequencies. The H(s) output signal will therefore lack certain portions of the total input spectrum of the monaural signal M due to this spectral intensity modulation. The output signal H(s) comprises one channel of the stereo synthesizer, and a typical response curve of the H(s) channel is shown at B of FIG. 1.

The second channel of the stereo synthesizer is produced by subtracting the output signal of the transfer function circuit 20 from the original monaural signal M in the differential amplifier 40. The signal produced at the output of the differential amplifier 40, M-H(s) is the complement of the H(s) channel, since it contains those components of the monaural signal M which the H(s) signal lacks. A typical response curve of the M-H(s) channel is shown at C of FIG. 1.

It may be seen that the two channels H(s) and M-H(s) together comprise the entire sound spectrum of the original monaural signal M. This may be determined by adding the signals from the two channels:

$$H(s)+[\mathrm{M}-\mathrm{H}(s)]=M+\mathrm{H}(s)-\mathrm{H}(s)=\mathrm{M}$$

Thus, the entire sound spectrum of the original monaural signal M is preserved in the two channels. However, the sound field has an increased ambience due to the varying distribution of the sound field between the two channels. The intensities of different frequency sound signals are reproduced in varying ratios in the two channels due to the spectral intensity modulation of the H(s) transfer function.

Moreover, since it is this spectral intensity modulation which produces the perceived ambience effect, only the differing magnitudes of the signals produced by the two channels are important for stereo synthesis. A corollary of this statement is that the ambience effect will still be obtained if the polarities of the two inputs of the differential amplifier 40 are reversed. When these input polarities are reversed, the monaural signal M is subtracted from the transfer function signal H(s), and the signal produced by the differential amplifier 40 is (H(s)-M). The magnitude of this signal is seen to be $$|[H(s) - M]| = |-[H(s) - M]|$$
$$|[-H(s) + M]|$$
$$|[M - H(s)]|$$

which is identical to the result previously obtained.

A stereo synthesizer constructed in accordance with the principles of the present invention is shown in schematic detail in FIG. 2. A monaural sound signal is applied to an input terminal 100. The monaural signal is coupled to the input of the H(s) transfer function circuit 20 by a resistor 102. The transfer function circuit 20 is comprised of two cascaded twin-tee notch filters 200 and 220. It should be noted that the circuit providing the H(s) function may be implemented in a variety of ways not fully described in this application. For example, circuits providing the H(s) transfer function have been constructed using parallel transistorized bandpass filters and cascaded transistorized bandstop filters. However, the use of the twin-tee notch filters shown in FIG. 2 is advantageous in that, by impedance scaling the circuit, the need for transistors or other active circuit components is eliminated from the transfer function circuit.

The first twin-tee notch filter 200 of the cascaded pair exhibits a characteristic response with a sharp attenuation, or notch, at a predetermined frequency, in this example, 150 Hz. The filter 200 is comprised of a first path including two series coupled capacitors, 202 and 206, between its input and output. A resistor 204 is coupled from the junction of the capacitors 202 and 206 to a source of reference potential (ground). The filter 200 also includes a second signal path in parallel with the first, comprising two series coupled resistors 208 and 212. A capacitor 210 is coupled from the junction of the resistors 208 and 212 to ground. The capacitor 202 and the resistor 204 act as a differentiator which provides a phase lead to input signals supplied by resistor 102. The resistor 208 and capacitor 210 act as an integrator, which provides a phase lag to input signals in that signal path. At a certain frequency, in this case 150 Hz, the signal supplied by capacitor 206 leads the signal supplied by resistor 212 by 180 degrees, and since the signals were identical in amplitude and phase at the input, two 150 Hz signals will cancel at the junction of capacitor 206 and resistor 212. This cancellation produces the characteristic notch in the response curve of the twin-tee filter.

The second twin-tee notch filter 220 is constructed in a manner similar to filter 200. A first signal path is coupled from the output of filter 200 to the output of the H(s) transfer function circuit 20, comprising two series coupled capacitors 222 and 226. A resistor 224 is coupled from the junction of the capacitors 222 and 226 to ground. A second path, comprised of series coupled resistors 228 and 232, is coupled in parallel with the first path. A capacitor 230 is coupled from the junction of resistors 228 and 232 to ground. This second notch filter 220 operates in a similar fashion to notch filter 200 and produces a characteristic notch at 4600 Hz in this example. The component values of the second notch filter 220 are greater than those used in the first notch filter 200 to avoid loading the first filter 200. By scaling the two notch filters such that the second notch filter 220 has a higher impedance than the first, the need for buffer transistors or other active circuit elements is eliminated in the transfer function circuit 20, as mentioned previously.

The signal produced by the transfer function circuit 20 is coupled to the positive inputs of two differential power amplifiers 40 and 42 by a coupling capacitor 112. A filter capacitor 114 is coupled from the two positive power amplifier inputs to ground. The differential power amplifier 40 is used to generate a difference signal from the H(s) transfer function signal and the monaural signal. The power amplifier 42 is used to match the impedance of the H(s) signal channel to that of the H(s)-M channel.

Power amplifier 42 has a negative input coupled to ground by the serial connection of a resistor 122 and a capacitor 120. A feedback resistor 124 is coupled from the output of the power amplifier 42 to the negative input. The ratio of the feedback resistor 124 to the negative input resistor 122 determines the gain of the power amplifier 42. In the example shown in FIG. 2, the gains of the two power amplifiers 40 and 42 are approximately equal. The power amplifier 42 drives a load comprising the serial connection of a resistor 126 and a capacitor 128 from the output of the power amplifier to ground. The H(s) signal at the output of the power amplifier is coupled to a switch terminal 152 by a capacitor 130.

The monaural sound signal at the input terminal 100 is coupled to the parallel combination of a resistor 104 and a potentiometer 106 by the resistor 102. The opposite end of this parallel combination is coupled to ground. The wiper arm of the potentiometer 106 is coupled to the negative input of power amplifier 40 by the serial connection of a capacitor 108 and a resistor 110. A feedback resistor 132 is coupled from the output of the power amplifier 40 to the negative input terminal. The power amplifier 40 drives a load comprised of the serial connection of a resistor 134 and a capacitor 136 which is coupled from the output of the power amplifier 40 to ground. The difference signal developed at the output of the power amplifier 40, H(s)-M, is coupled to a switch terminal 158 by a capacitor 140.

Switch 150 is a double pole, double throw switch used to select either monophonic reproduction or synthetic stereo reproduction. The monaural sound signal at the input terminal 100 is coupled to switch terminals 156 and 162. Blade 154 is coupled to a first loudspeaker 170, and blade 160 is coupled to a second loudspeaker 172. When the blades are in the upper position, the H(s) signal at switch terminal 152 is coupled to loudspeaker 170 by blade 154, and the H(s)-M signal at switch terminal 158 is coupled to loudspeaker 172 by blade 160. The loudspeakers will produce a synthetic stereo sound field when switch 150 is in this position. When the blades are moved to their lower positions, the monaural signal at switch terminals 156 and 162 is coupled to the loudspeakers for the generation of a monophonic sound field.

The potentiometer 106 provides a means for adjusting the depths of the notches in the H(s)-M signal developed by the differential amplifier 40. The monaural sound signal which is supplied to the differential amplifier 40 is attenuated by the potentiometer in an amount determined by the setting of the wiper arm of the potentiometer. In this way, the amplitude of the M signal which is subtracted from the H(s) signal by the differential amplifier 40 is controlled. The potentiometer is usually set to provide an M signal with an amplitude equal to that of the H(s) signal at the 700 Hz notch frequency of the H(s)-M signal.

Figure 4:
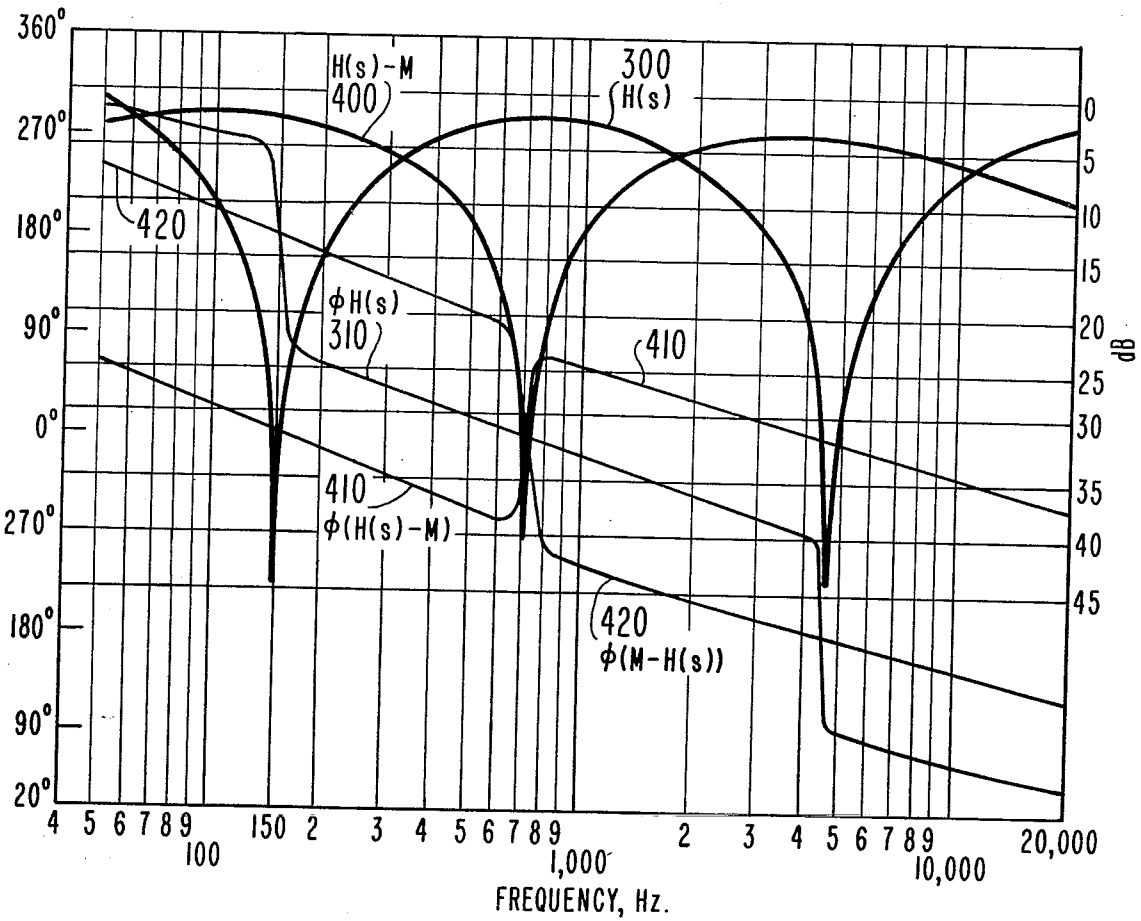
FIGS. 4 and 5 illustrate response curves of the stereo synthesizer of FIG. 2.

The depths of the H(s)-M signal notches, and the frequencies at which they are located, are also determined by the phase of the H(s) signal. This is illustrated by the response curves of the circuit of FIG. 2, which are shown in FIG. 4. The intensity, or amplitude, of the H(s) signal channel produced by the cascaded twin-tee notch filters 200 and 220 is illustrated as a function of frequency by response curve 300. This response curve 300 is seen to have its characteristic notches located at 150 Hz and 4600 Hz. The complementary response curve 400 of the H(s)-M signal channel is seen to have a notch at approximately 700 HZ, at which frequency the amplitude of the H(s) response curve 300 is at a maximum.

The location of the notches in the audio frequency spectrum is of particular significance when the stereo sound synthesizer is used in conjunction with a visual image, such as a television receiver. This is because sounds at the notch frequencies have a distinct directional characteristic, as sounds at these frequencies are fully reproduced in one loudspeaker and fully attenuated in the other. Moreover, it follows that sounds at the crossover points of the amplitude vs frequency response curves 300 and 400 will be reproduced with equal intensity in both channels, thereby locating these sounds at a point intermediate the two loudspeakers. Thus, since the location of the notches concomitantly locates the crossover points in the audio frequency spectrum, the notch locations are critical in the determination of those frequencies at which sounds will appear to be centered with respect to the two loudspeakers.

It is desirable for the H(s) signal to be in phase with the M signal when the response curve 300 of the H(s) signal is at a maximum in order to produce a truly complementary H(s)-M response of maximum notch depth. The phase of the M signal is taken as the reference phase in FIG. 3, and is assumed to be 0° throughout the frequency spectrum of the monaural signal M. The phase response of the H(s) signal is represented by curve 310, and is seen to be approximately 0° when the amplitude of the H(s) response curve 300 is at a maximum at 700 Hz. Thus, since the M signal is used as the reference amplitude in FIG. 4, with a constant amplitude equal to the maximum amplitude of the H(s) signal, subtraction of the H(s) and M signals by the differential amplifier 40 results in virtually a complete cancellation of the H(s)-M signal at 700 Hz, and therefore a notch of maximum depth. The degree of mutual cancellation of the two signals by the differential amplifier 40 is controlled by the adjustment of the amplitude M signal by the potentiometer 106, as discussed above.

The phase reponse curve 310 of the H(s) signal channel shows that the H(s) signal channel has a linearly decreasing phase angle relative to the M signal between the notch frequencies of 150 Hz and 4600 Hz. In the vicinity of these notch frequencies, the H(s) signal undergoes a 180° phase reversal. The H(s)-M signal channel is seen to have a similarly unique phase response curve 410 which behaves in a similar fashion. Moreover, the phase response curve 310 and 410 of the two channels reveal that the two signals are in a substantially constant phase relationship of approximately 90° between the notch frequencies, and are momentarily either in phase or out of phase at the notch frequencies.

The phase and amplitude response curves of FIG. 4 indicate the manner in which the sounds produced by the two loudspeakers 170 and 172 develop the perceived ambience of the stereo synthesizer. Since the loudspeaker sound signals are in a substantially constant 90° phase relationship between the notch frequencies, they will neither additively combine (as they would if they were in phase) nor will they cancel each other (as they would if they were 180° out of phase) at the ears of the listener. Instead, the responses of the loudspeakers will be substantially as shown by the amplitude response curves 300 and 400, without a phase "tilt" which would tend to reinforce or cancel sound signals at certain frequencies. Thus, it may be seen that the perceived ambience effect is developed by the varying ratios of the sound signal amplitudes produced by the loudspeakers over the sound frequency spectrum. The phase relationship of the two output signals is of even less significance when the two loudspeakers are not widely separated, as is the case when they are located on either side of a television kinescope.

Moreover, it has been found that a phase differential of 90° between the two output signals will produce a distributed sound field which appears to just cover the space between the two loudspeakers. At phase differentials less than 90°, the distribution is narrower, and at phase angles in excess of 90° the sound field increases in dimension until it appears to cover the entire 180° plane of the two loudspeakers. This phenomenon is advantageous when the stereo synthesizer is used in cooperation with a visual medium which occupies the entire space between the loudspeakers, such as a movie screen or television kinescope, as the sound field will then appear to emanate from throughout the visual image, but not beyond its physical boundaries.

Of course, the sound signals of the two channels are exactly in phase and out of phase at the notch frequencies, and thus would tend to reinforce or cancel each other at these frequencies. However, since one sound signal is always fully attenuated at the notch frequecies, there is virtually no signal reinforcement or cancellation at the notch frequencies.

The phase response curve 420 of the M-H(s) signal illustrates graphically a point that was previously demonstrated mathematically: that the reversal of the input polarities of the differential amplifier 40 to produce an M-H(s) signal instead of H(s)-M signal will result in the same synthetic stereo effect. As expected, the amplitude response curve 400 is the same for both different channel signals, but the phases of the two signals are 180° apart. The M-H(s) phase response curve 420 shows that the M-H(s) signal and the H(s) signal are still related by approximately 90° between the notch frequencies, and are momentarily either in phase or out of phase at the notch frequencies. The only difference between the two different channel phase response curves is that the H(s)-M signal leads the H(s) signal by approximately 90° in phase at frequencies at which the M-H(s) signal lags the H(s) signal in phase by the same amount. Understandably, the converse is also true.

Since the two loudspeakers 170 and 172 produce sound signals which correspond to the amplitude response curves 300 and 400 of FIG. 3, it may be appreciated that different frequency sounds will appear to come from different loudspeakers, or some point between the two. For instance, if the H(s) signal loudspeaker 170 is placed to the left of the listener and the H(s)-M loudspeaker 172 to the right, a 50 Hz tone will be reproduced primarily in the right loudspeaker, and a 700 Hz tone would come from the left loudspeaker. Tones between these two notch frequencies would appear to come from locations intermediate the left and right loudspeaker; and a 320 Hz tone would appear to come from a point halfway between the two loudspeakers, since such a tone will be reproduced with equal intensity in the two loudspeakers. When the synthetic stereo system reproduces sound signals having a large number of different frequency components, such as music from a symphony orchestra or the voices of a large crowd, different frequency components will appear to come simultaneously from different directions, giving the listener a more realistic sensation of the ambience of the concert hall or crowd.

As mentioned previously, the stereo synthesizer of the present invention may be used in conjunction with a visual medium, such as a television receiver, to create a more realistic audio and visual effect for the viewer. A television receiver 180 employing the stereo synthesizer of FIG. 2 is shown in FIG. 3. The television kinescope 182 should be centered between the two loudspeakers 170 and 172 which are located close to the sides of the kinescope, as illustrated in FIG. 3, to prevent the sound field from appearing significantly larger than the scene being viewed. More importantly, the relative intensities of different frequency signals in the two sound channels must be carefully controlled through proper selection of the notch and crossover frequencies of the response curves 300 and 400 to avoid the confusing reversal of the directions of the sound and image to which reference was made previously.

To understand how the transfer function filter notches should be arranged to properly locate the crossover points of equal intensity in the sound spectrum, it is necessary to examine the content of television programming source material. The majority of television programming contains images of individuals who are talking or singing. Since the synthetic stereo system has no way of determining the relative locations of the images of the individuals, the system must not operate so as to reproduce human voices with a degree of directionality, to prevent possible reversal of the voice locations with respect to the images of the individuals. Hence, the synthetic stereo system should reproduce human voices with equal intensity in the two loudspeakers so that the voices will appear to emanate from the center of the picture. Sounds with little or no visual directional content, on the other hand, can be reproduced so as to appear to emanate from various locations in the television image. For instance, suppose that the viewer is observing a scene depicting two individuals talking to each other in the foreground of a busy office. A satisfactory synthetic stereo sensation will be produced when the voices of the two individuals appear to emanate from the center of the screen, and the various background noises of typewriters, telephones, et cetera, appear to emanate from throughout the televised image. Under these conditions, the viewer will have an increased sensation of being in the office (when compared to monaural reproduction) without the possibility of receiving confusing auditory information as to the relative location of the two individuals in the scene.

Figure 5:
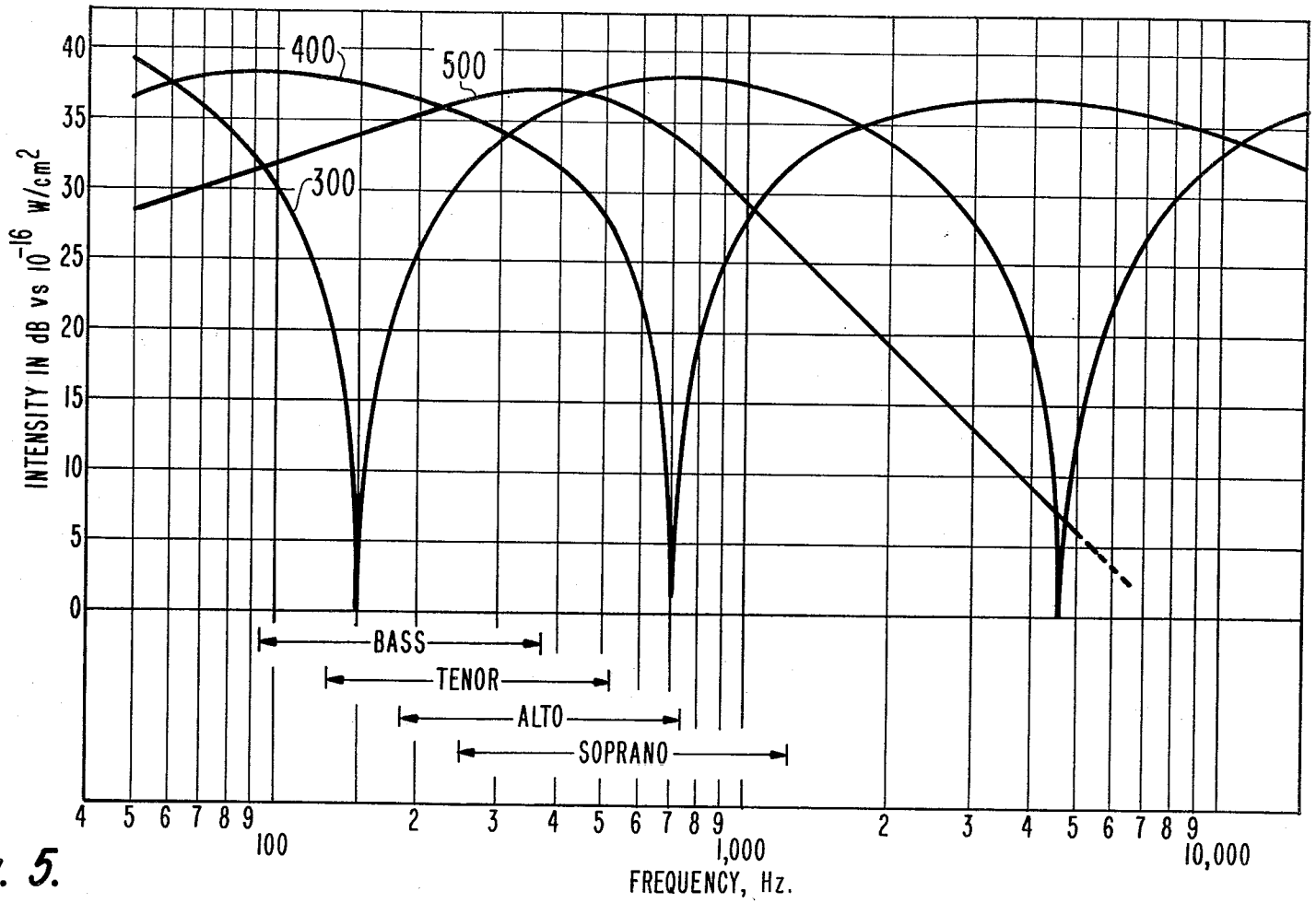

To accomplish the centering of the human voices in the picture, it is helpful to understand the anatomy of human speech with respect to the audible frequency spectrum. FIG. 5 shows a comparison of the amplitude response curves 300 and 400 of the stereo synthesizer, and the average intensity vs. frequency response curve 500 of the human voice. As curve 500 illustrates, the human voice has an average intensity which peaks around 350 Hz. Above this frequency, voice power drops off rapidly. Below the response curves are shown the frequency ranges of bass, tenor, alto and soprano singing voices. It may be seen that these frequency ranges are approximately centered about the crossover frequency of the stereo synthesizer, 320 Hz, at which the amplitudes of the signals produced by the two sound channels are equal, so as to produce a centered sound sensation. Moreover, this 320 Hz crossover frequency is also very near the peak of the voice intensity response curve 500. The stereo synthesizer here shown will therefore produce a centering effect near the frequency at which the human voice is producing, on the average, the most voice power. This is accomplished by locating the first and second notches at 150 Hz and 700 Hz, respectively, to produce the desired crossover frequency at 320 Hz.

Figure 6:
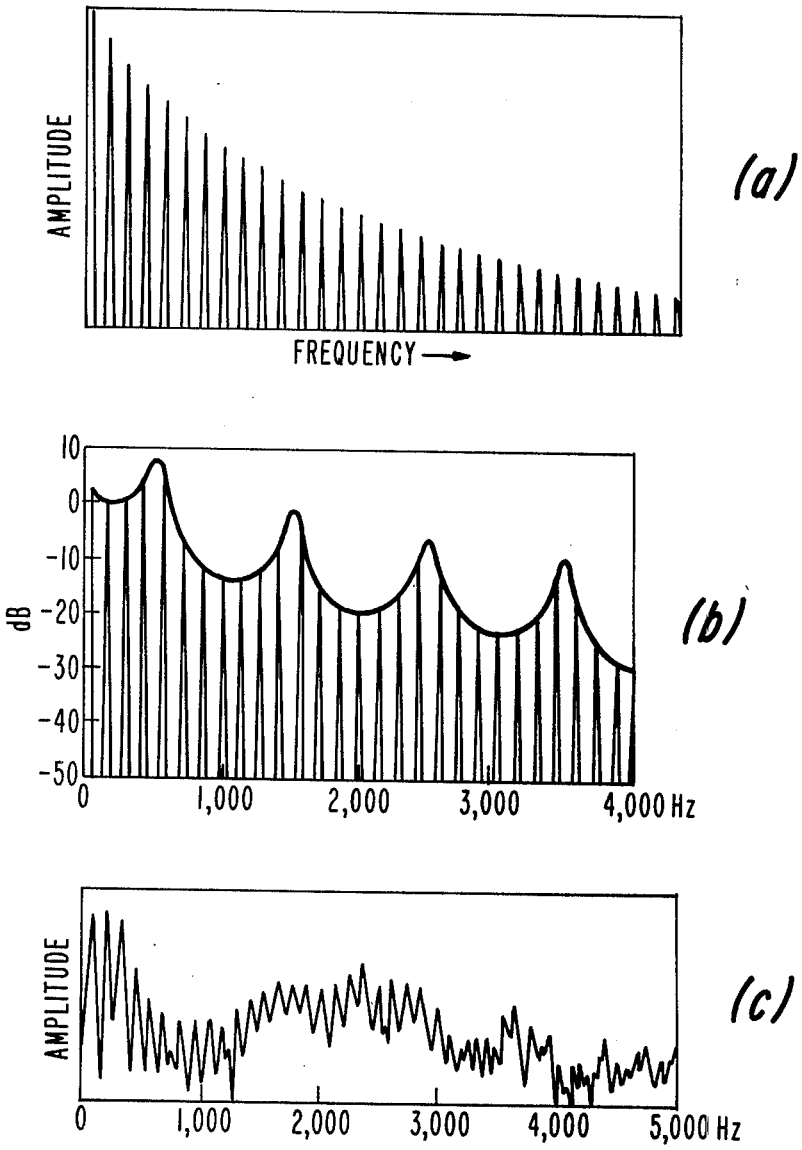
FIGS. 6*a–c* and 7 illustrate response curves of the human voice and the stereo synthesizer of the present invention.

A further understanding of human voice production is necessary to analyze the frequency location of the third notch. The voiced sounds of speech are produced by forcing air from the lungs through the larynx, or voicebox. The larynx contains two folds of skin, or vocal cords, which are separated by an opening called the glottis. The vocal cords vibrate at a fundamental frequency having higher overtones or harmonics which define the pitch of the voiced sound. The amplitude of the vocal cord harmonics decrease with frequency at the rate of about 12 decibels per octave, as illustrated in FIG. 6(*a*). The pitch of the vocal cord vibrations is changed during singing or talking by constricting or relaxing the muscles in the larynx which control the vocal cords.

The sounds produced by the vocal cords pass through the pharynx and the mouth which, together with the larynx, comprise the vocal tract. The vocal tract from the larynx to the lips acts as a resonant cavity which attenuates certain frequencies to a lesser degree than others. The vocal tract has four or five important resonant frequencies called formant frequencies, or simply formants. The closer a vocal cord harmonic is to a formant, the less it is attenuated as it passes through the vocal tract; hence, the greater its amplitude when radiated at the lip opening. The formant frequencies may be shifted during speech by altering the position of the voice articulators: the lips, the jaw, the tongue and the larynx. A singer or trained public speaker will take advantage of these formant frequencies by altering his articulators so as to simultaneously shift his pitch frequency and a formant frequency into close proximity to produce a sound of greater relative amplitude, or loudness, without the need for increased air pressure from the lungs.

Formants are labeled F1, F2, F3, et cetera, in the order in which they appear in the frequency scale. The relative importance of the individual formants decreases with increasing order above F2, since the intensity of higher order formants decreases exponentially. The first formant F1 varies for male speakers over a range of 250 to 700 Hz and the distances between the formants on the frequency scale average 1000 Hz. A typical formant pattern for a male is shown in FIG. 6(*b*). Since the formant frequencies are a function of vocal tract dimensions, females have larger average formant spacings and higher average formant frequencies than males. Similar relations hold for children compared with adults.

Two speakers uttering the same sound generally have somewhat different formant frequencies depending on their particular vocal tract dimensions. However, in a particular context, it is always to be expected that any speaker adhering to the basic principles of his language will produce different sounds by means of consistent distinctions in the formant pattern. Thus, once these individual formant variations are identified and taken into consideration, the words and sounds of any speaker can be identified by the relative formant positions on the frequency scale. For example, the first and second formants of the word "heed", located at 270 and 2290 Hz, respectively, are readily identifiable in the sound spectrum envelope shown in FIG. 6(*c*).

It has been found that only the first three formants are necessary to identify any particular sound; higher order formants only provide certain information on personal voice characteristics. F1 and F2 are the main determinants of vowel quality, but it is the location of F2 with respect to F1 and F3 which determines the intelligibility of speech, a measure usually referred to as articulation. This is due to the fact that the vowel sounds which predominate in common speech have a higher energy content than consonants since they are "voiced", that is, they depend upon vocal cord vibrations for their production. By contrast, consonant sounds, which may be characterized in general as breaks in vowel sounds (i.e. /t/ and /p/), do not require vocal cord vibrations for their production (except for the vowel-like consonants /r/, /m/, /n/, /ng/ and /l/ and hence are produced with reduced loudness as compared with vowels. On the average, unvoiced consonants are 20 db weaker than vowel sounds. It has been found that the ability of a listener to discern the weaker consonant sounds is the prime determinant of the articulation measure of speech.

While consonants, like vowels, have their own particular formant frequencies, it is not the formants of the consonants alone which govern articulation. Rather, the quality of a consonant is determined by its effect on the vowel or vowels with which it is associated, as characterized by its effect on the second formant of the vowel, called the "hub" of the speech sound. In general, a consonant before or after a vowel causes the second formant of the vowel to proceed away from the hub or "locus" F2 of a preceding consonant or toward the hub of a succeeding consonant. It is this transitional behavior of the second formant of a vowel before or after a consonant which gives a vital clue to the identity of that consonant.

Figure 7:
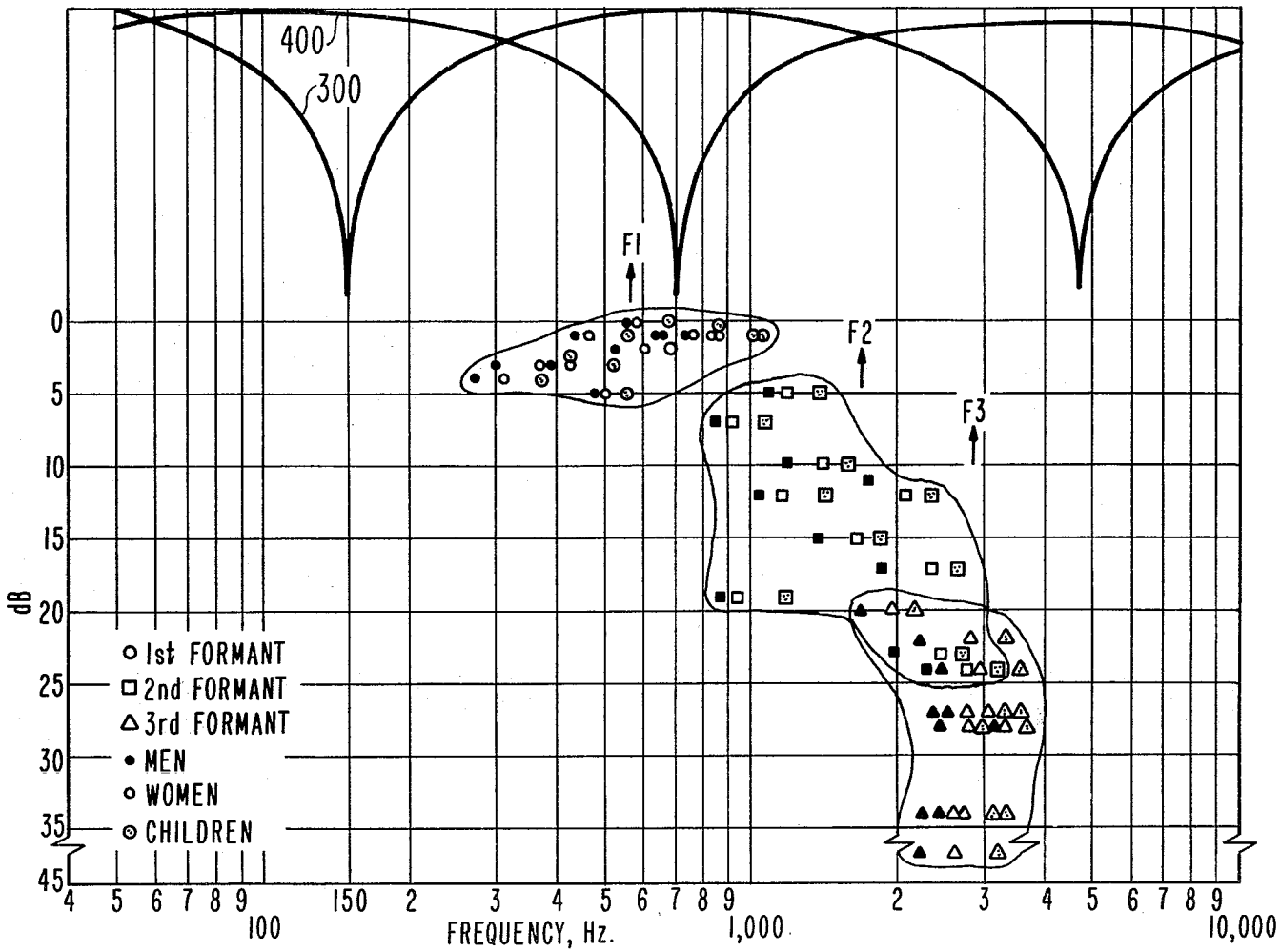

It is therefore seen that if the stereo synthesizer of the present invention is to provide both a centered and a clearly articulated speech sound, it is desirable for the formant frequencies of speech sounds to be produced with near equal intensities in the two loudspeaker channels. FIG. 7 illustrates that the location of the upper notch frequency at 4600 Hz, together with the location of the intermediate notch at 700 Hz, provide a crossover of equal loudspeaker signal amplitudes at approximately 1680 Hz. Below these loudspeaker channel response curves are plotted the locations of the first three formants for the ten most common vowel sounds. The formant frequencies shown are average values for men, women and children. It is seen that the first formant values range from 270 Hz to 1050 Hz, with a mean value of 560 Hz, designated by arrow F1. Although the response curves of the two loudspeaker channels show an intensity differential of approximately 12 db at this mean value, it must be remembered that the lower crossover frequency at 320 Hz is a compromise between the ranges of pitch frequencies of the human voice, the intensity distribution of the human voice, and the first formant frequencies. Since the pitch frequencies are generally lower than the first formant frequencies, ranging down to 90 Hz for bass voices, it is not surprising that the voice intensity curve 500 should peak at a frequency intermediate the average pitch and first formant frequencies. The lower crossover frequency of 320 Hz is satisfactory because it is closely related to the peak of the voice intensity response curve 500.

FIG. 7 shows second formant frequencies ranging from 850 Hz to 3200 Hz, and third formant frequencies varying from 1680 Hz to 3500 Hz. Second formant amplitudes are an average of 12 db below the average of first formants, and the third formants have an average amplitude which is over 26 db below that of the first formants. The mean frequencies for the second and third formants are represented by arrows F2 and F3, respectively. It is seen that the intensity levels of the two loudspeakers are approximatly 5 db apart at the mean value of the third formant F3, and that the mean value of the important hub formant F2 is almost exactly at the equal intensity crossover point of the two loudspeaker channels. Thus, the second formant will, on the average, be produced with equal intensity by both loudspeakers. The voice sounds thereby reproduced will appear centered with respect to the television image, and will have an enhanced intelligibility, or articulation.

Returning to the earlier example of the two speakers in the office, it may be seen from the foregoing that the stereo synthesizer of the present invention will create the impression that the voices of the speakers are coming from the center of the television image. The background noises which are produced in the office environment are distributed fairly randomly over the sound spectrum, ranging from approximately 30 Hz to 1600 Hz. These background sounds will be reproduced by the loudspeakers in varying ratios in accordance with the response curves 300 and 400 of FIG. 4, thereby creating a distinct ambience effect as the office sounds appear to emanate from throughout the televised image. Viewing pleasure is increased as the television viewer gains an increased sensation of being a part of the office scene, instead of merely sitting in his living room easy chair.

What is claimed is:

1. A stereo synthesizer for synthesizing stereo sound signals from monophonic input signals comprising:

a source of monophonic sound signals;

a transfer function circuit responsive to said monophonic sound signals and having an amplitude versus frequency characteristic which exhibits two spaced frequencies of minimum attenuation and a frequency of maximum attenuation intermediate said spaced frequencies within an audio frequency range occupied by said monophonic sound signals, and a phase versus frequency characteristic which exhibits phase variations with frequency over said audio frequency range, for producing a phase and intensity modulated signal;

a difference circuit having a first input and a second input for developing a difference signal representative of the difference between the signals applied to said first and second inputs;

means for applying said phase and intensity modulated signal to said first input;

means for transferring monophonic sound signals from said source to said second input without introduction of variations in amplitude or phase with frequency over said audio frequency range;

first utilization means responsive solely to said phase and intensity modulated signal for producing a first synthesized stereo sound signal; and second utilization means responsive to said difference signal for producing a second synthesized stereo sound signal.

2. A stereo synthesizer for synthesizing stereo sound signals from monophonic input signals comprising:

a source of monophonic sound signals;

a transfer function circuit responsive to said monophonic sound signals and having an amplitude versus frequency characteristic which exhibits two spaced frequencies of maximum attenuation and a frequency of minimum attenuation intermediate said spaced frequencies within an audio frequency range occupied by said monophonic sound signals, and a phase versus frequency characteristic which exhibits phase variations with frequency over said audio frequency range, for producing a phase and intensity modulated signal;

first and second loudspeakers;

a differential amplifier having a first input and a second input for developing a difference signal representative of the difference between the signals applied to said first and second inputs;

means for applying said phase and intensity modulated signal to said first input;

means for transferring monophonic sound signals from said source to said second input without introduction of variations in amplitude or phase with frequency over said audio frequency range;

means solely responsive to the output of said transfer function circuit for coupling said phase and intensity modulated signal to said first loudspeaker; and means for coupling said difference signal to said second loudspeaker.

3. The stereo synthesizer of claim 2 or 24, wherein said transfer function circuit comprises first and second cascaded twin-tee notch filters.

4. The stereo synthesizer of claim 3, wherein the impedance of said second twin-tee notch filter is greater than the impedance of said first twin-tee notch filter.

5. The stereo synthesizer of claim 2, wherein said first input of said differential amplifier is a noninverting input and said second input is an inverting input.

6. The stereo synthesizer of claim 2, wherein said first input of said differential amplifier is an inverting input and said second input is a noninverting input.

7. The stereo synthesizer of claim 2, wherein said means for coupling said phase and intensity modulated signal to said first loudspeaker comprises:

a second differential amplifier having a noninverting input response to said phase and intensity modulated signal and an output; and means for coupling the output of said second differential amplifier to said first loudspeaker.

8. The stereo synthesizer of claim 7, wherein the impedance of the first input of said first differential amplifier is substantially equal to the impedance of the noninverting input of said second differential amplifier, and the output impedances of said first and second differential amplifiers are substantially equal.

9. The stereo synthesizer of claim 8, wherein the input impedance of said first differential amplifier is substantially greater than the output impedance of said transfer function circuit.

10. The stereo synthesizer of claim 2, wherein said means for transferring monophonic sound signals to said second input includes a resistive divider network.

11. The stereo synthesizer of claims 2 or 24, wherein said means for coupling said phase and intensity modulated signal to said first loudspeaker comprises a first switch having a first input terminal for receiving said phase and intensity modulated signal, a second input terminal coupled to said source of monophonic sound signals, and means for alternatively coupling said first or second terminal to said first loudspeaker, and said means for coupling said difference signal to said second loudspeaker comprises a second switch having a third input terminal for receiving said difference signal, a fourth input terminal coupled to said source of monophonic sound signals, and means for alternatively coupling said third or fourth terminal to said second loudspeaker.

12. The stereo synthesizer of claim 7, wherein said means for coupling the output of said second differential amplifier to said first loudspeaker comprises a first switch having a first input terminal coupled to the output of said second differential amplifier, a second input terminal coupled to said source of monophonic sound signals, and means for alternatively coupling said first or second terminal to said first loudspeaker, and said means for coupling said difference signal to said second loudspeaker comprises a second switch having a third input terminal for receiving said difference signal, a fourth input terminal coupled to said source of monophonic sound signals, and means for alternatively coupling said third or fourth terminal to said second loudspeaker.

13. The stereo synthesizer of claim 2, wherein said transfer function circuit comprises a first stereo signal channel, and said transfer function circuit, said differential amplifier, said applying means and said monophonic sound signal transferring means comprise a second stereo signal channel.

14. The stereo synthesizer of claim 13, wherein said first stereo signal channel has an amplitude versus frequency characteristic which exhibits notches of minimum amplitude at said two spaced frequencies and a point of maximum amplitude at said frequency intermediate said spaced frequencies.

15. The stereo synthesizer of claim 14, wherein said second stereo signal channel has an amplitude versus frequency characteristic which exhibits a notch of minimum amplitude at said intermediate frequency and points of maximum amplitude at said two spaced frequencies.

16. The stereo synthesizer of claim 15, wherein said amplitude versus frequency characteristics of said first and second stereo signal channels exhibit crossover points at which the amplitudes of said amplitude versus frequency characteristics are equal at a first frequency intermediate one of said two spaced and said intermediate frequencies and at a second frequency intermediate said intermediate and the other of said two spaced frequencies.

17. The stereo synthesizer of claim 16, wherein said first frequency is substantially equal to the average frequency of maximum intensity of the human voice, and said second frequency is substantially equal to the average of the second formant frequencies of the human voice.

18. The stereo synthesizer of claim 24, wherein said substantially constant phase relationship is substantially 90 degrees.

19. The stereo synthesizer of claim 14, wherein said transfer function circuit comprises the serial coupling of a first twin-tee notch filter for producing the characteristic notch at one of said two spaced frequencies, and a second twin-tee notch filter for producing the characteristic notch at the other of said two spaced frequencies.

20. In a television receiver including a kinescope, a stereo synthesizer for producing synthesized stereo sound signals from a source of monophonic input signals comprising:

first and second loudspeakers located on either side of said kinescope;

a first signal responsive to said monophonic input signals and having an output coupled to said first loudspeaker for producing a first synthesized stereo sound signal, said first channel exhibiting an amplitude versus frequency response characteristic with a first notch of minimum amplitude at a frequency below the average first formant frequency of the human voice, and a second notch of minimum amplitude at a frequency above the average third formant frequency of the human voice; and a second signal channel responsive to said monophonic input signals and having an output coupled to said second loudspeaker for producing a second synthesized stereo sound signal, said second channel exhibiting an amplitude versus frequency response characteristic with a notch of minimum amplitude at a frequency intermediate the average first and second formant frequencies of the human voice, wherein said first and second response characteristics exhibit respective equal amplitudes at a first frequency substantially equal to the average frequency of maximum intensity of the human voice, and at a second frequency substantially equal to the average second formant frequency of the human voice.

21. The television receiver of claim 20, wherein the phase difference between said first and second synthesized stereo sound signals is substantially equal to ninety degrees at frequencies intermediate said notch frequencies.

22. In a television receiver including a kinescope, a stereo synthesizer for producing synthesized stereo sound signals from a source of monophonic input signals occupying a given band of frequencies comprising:

first and second loudspeakers located on either side of said kinescope;

a first signal channel responsive to said monophonic input signals and having an output coupled to said first loudspeaker for producing a first intensity modulated signal, said first channel exhibiting a first response characteristic which varies in amplitude as a function of frequency over said given band of frequencies; and a second signal channel responsive to said monophonic input signals and having an output coupled to said second loudspeaker for producing a second intensity modulated signal, said second channel exhibiting a second response characteristic which varies in amplitude as a function of frequency over said given band of frequencies, said second response characteristic differing from said first response characteristic such that monophonic signal components having frequencies lying within selected different portions of said given band of frequencies are translated substantially exclusively by respectively different ones of said signal channels, wherein said first and second response characteristics exhibit respective equal amplitudes at a first frequency substantially equal to the frequency of maximum intensity of the average human voice, and at a second frequency substantially equal to the average second formant frequency of the human voice.

23. In a television receiver including a kinescope, a stereo synthesizer for producing synthesized stereo sound signals from a source of monophonic input signals comprising:

a transfer function circuit responsive to said monophonic sound signals for producing an intensity modulated signal which varies in amplitude as a function of frequency;

a differential amplifier having a first input responsive to said intensity modulated signal and a second input responsive to said monophonic sound signals for producing a difference signal which varies in amplitude as a function of frequency;

a first loudspeaker located on one side of said kinescope and responsive to said intensity modulated signal for producing a first synthesized stereo sound signal; and a sound loudspeaker located on the opposite side of said kinescope from said first loudspeaker and responsive to said difference signal for producing a second synthesized stereo sound signal, wherein said intensity modulated signal and said difference signal have respective equal amplitudes at a first frequency substantially equal to the frequency of maximum intensity of the average human voice, and at a second frequency substantially equal to the average second formant frequency of the human voice.

24. A stereo synthesizer for synthesizing stereo sound signals from monophonic input signals comprising:

a source of monophonic sound signals;

a transfer function circuit responsive to said monophonic sound signals for subjecting said monophonic sound signals to a first amplitude versus frequency characteristic which exhibits two spaced frequencies of maximum attenuation and a frequency of minimum attenuation intermediate said spaced frequencies within an audio frequency range occupied by said monophonic sound signals, and a first phase versus frequency characteristic which exhibits phase variations with frequency over said audio frequency range, for producing, at an output, a phase and intensity modulated signal;

means, having a first input responsive to a monophonic signal from said source and a second input responsive to said intensity and phase modulated signal, for subjecting said monophonic sound signal to a second amplitude versus frequency response exhibiting maximum attenuation at a frequency coincident with said intermediate frequency of minimum attenuation of said first amplitude versus frequency characteristics, and a minimum attenuation at two frequencies coincident with said two spaced frequencies of maximum attenuation of said first amplitude versus frequency characteristic, and a second phase versus frequency characteristic, significantly differing from said first phase versus frequency characteristic over said audio frequency range, to develop a difference signal exhibiting a substantially constant phase relationship with said intensity and phase modulated signal over portions of said audio frequency range lying below the lower of said spaced frequencies, lying between said lower frequency and said intermediate frequency, lying between said intermediate frequency and the upper of said spaced frequencies, and lying above said upper frequency, and departing from said constant phase relationship in the intermediate vicinity of said lower, intermediate, and upper frequencies;

first and second loudspeakers;

means solely responsive to the output of said transfer function circuit for coupling said phase and intensity modulated signal to said first loudspeaker; and means for coupling said difference signal to said second loudspeaker.

* * * * *

UNITED STATES PATENT AND TRADEMARK OFFICE

CERTIFICATE OF CORRECTION

PATENT NO. : 4,239,939

DATED : December 16, 1980

INVENTOR(S) : Patrick D. Griffis

It is certified that error appears in the above—identified patent and that said Letters Patent is hereby corrected as shown below:

| | |
|---|---|
| Column 2, line 9 | "the" first occurrence, should be "and" |
| Column 7, line 47 | "Figure 3" should be "Figure 4" |
| Column 8, line 2 | "curve" should be "curves" |
| Column 8, line 55 | "different" should be "difference" |
| Column 15, line 25 (Claim 20) | after "signal" insert --channel-- |
| Column 16, line 37 (Claim 23) | "sound" should be "second" |
| Column 18, line 6 (Claim 24) | "intermediate" should be "immediate" |

Signed and Sealed this

*Thirty-first* Day of *March 1981*

[SEAL]

*Attest:*

RENE D. TEGTMEYER

*Attesting Officer*

*Acting Commissioner of Patents and Trademarks*